United States Patent [19]

Margen

[11] 4,091,636

[45] May 30, 1978

[54] HEAT PUMP SYSTEM

[75] Inventor: Peter Heinrich Erwin Margen, Nykoping, Sweden

[73] Assignee: Aktiebolaget Atomenergi, Stockholm, Sweden

[21] Appl. No.: 762,194

[22] Filed: Jan. 24, 1977

[30] Foreign Application Priority Data

Feb. 3, 1976 Sweden ..... 7601150

[51] Int. Cl.[2] ..... F25B 27/02; F25D 23/12

[52] U.S. Cl. ..... 62/238; 62/260; 165/45

[58] Field of Search ..... 62/238, 260, 519, 524; 165/45

[56] References Cited

U.S. PATENT DOCUMENTS

| | | | |
|---|---|---|---|
| 2,461,449 | 2/1949 | Smith et al. | 62/260 |
| 2,503,456 | 4/1950 | Smith | 62/260 |
| 2,587,203 | 2/1952 | Papadopoulos | 62/260 |
| 2,751,761 | 6/1956 | Borgerd | 62/260 |
| 2,954,680 | 10/1960 | Ruff | 62/260 |
| 3,513,663 | 5/1970 | Martin, Jr. et al. | 62/238 |
| 3,782,132 | 1/1974 | Lohoff | 165/45 |
| 3,926,008 | 12/1975 | Webber | 62/238 |
| 3,989,183 | 11/1976 | Gustafsson | 62/238 |

FOREIGN PATENT DOCUMENTS

| | | | |
|---|---|---|---|
| 713,582 | 8/1931 | France | 62/260 |

*Primary Examiner*—Lloyd L. King

*Attorney, Agent, or Firm*—Burns, Doane, Swecker & Mathis

[57] ABSTRACT

A heat pump system having a vaporizer in heat exchange relationship with a glycol/water circuit which comprises an earth heat absorber and an ambient air heat absorber in parallel.

15 Claims, 4 Drawing Figures

HEAT PUMP SYSTEM

Figure 1:
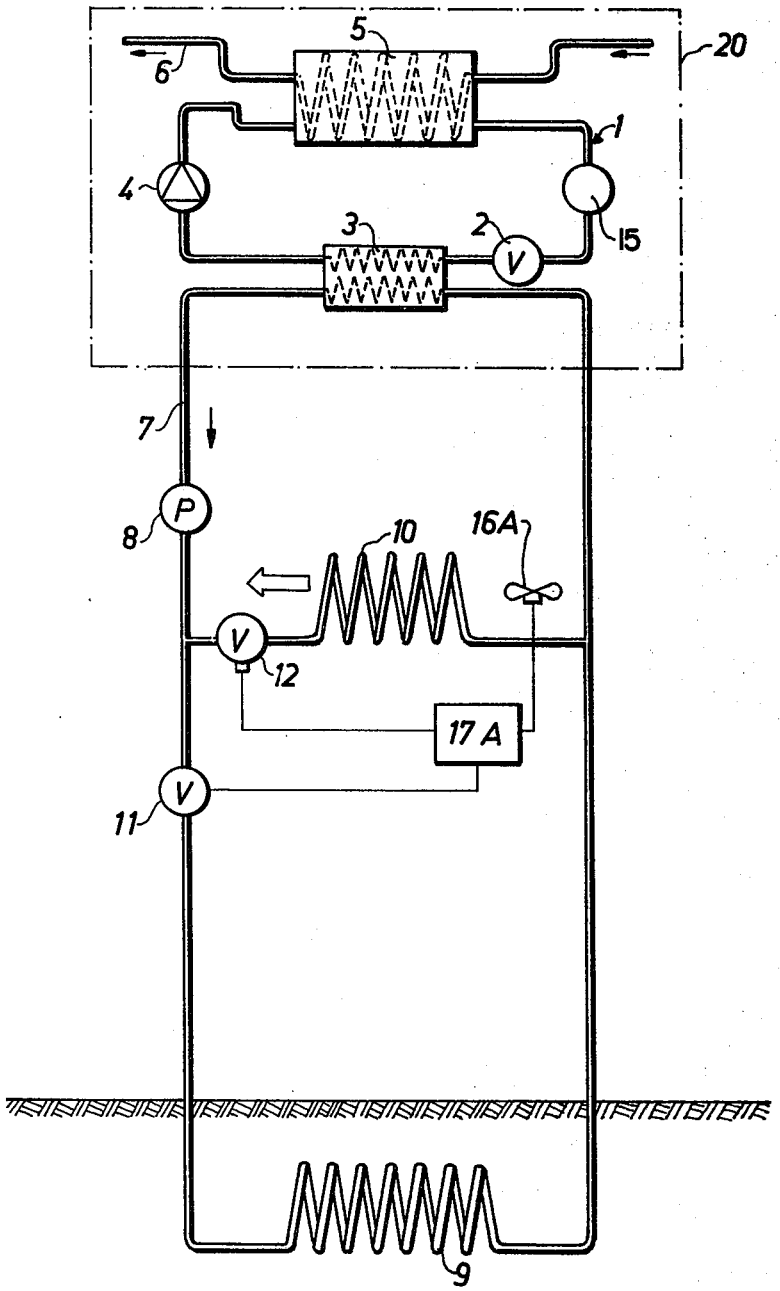

The invention refers to heat pump systems and pertains particularly to a heat pump system comprising a refrigerant circuit having, in series, an expansion valve, a first vaporizer, a compressor and a condenser, the condenser being arranged to transfer condensation heat of the refrigerant to a medium such as room air, radiator circuit water, tap water or the like, the vaporizer being arranged in heat exchange relationship with a secondary circuit which contains a liquid having low freezing temperature, such as a glycol/water mixture and a circulation pump, and moreover the secondary circuit comprises an earth heat absorber.

U.S. Pat. No. 2 503 456 (M.N. Smith) reveals a heat pump system of the general type indicated above. U.S. Pat. No. 2 461 449 (M.N. Smith et al) and French Pat. No. 2 265 045 reveal other heat pump systems of interest.

A heat pump system utilized for room heating purposes for example comprises a vaporizer which normally is arranged in contact with the ambient air, and the heat for vaporization of the refrigerant (Freon for example) of the heat pump circuit is absorbed from the ambient air, however, when the ambient air has relatively low temperature the moisture content of the air will condense on the condenser and freeze due to the relatively low temperature prevailing within the vaporizer. Vaporizer currently used consist normally of a flanged metal tubing having a relatively small interval between the flanges. This often leads to a frost clogging of the air channels between the flanges, such that the efficiency of the heat pump decreases, possibly in such an extent that the heat pump cannot work any longer. To this end it is common practice to defrost the vaporizer but it is very tricky to devise properly functioning, economic methods and apparatus for such defrosting.

Therefore it would be desireable to provide a system wherein such defrosting is not necessary. The above mentioned U.S. Pat. No. 2 503 456 reveals one solution to this particular problem, but the prerequisite of a deep well is not easily satisfied. Moreover, the heat energy amount available in such a ground or earth heat energy recovery system is limited, which means that the earth circuit has to be very wide-spread in order to ensure a proper functioning of the heat pump during a time period of several years.

One object of the invention is therefore to provide a heat pump system wherein the drawbacks of the above mentioned previously known systems are avoided.

According to the invention heat is supplied to the vaporizer of the heat pump via a secondary circuit containing a liquid having low freezing temperature, and this secondary circuit comprises both an earth heat absorber and an air heat absorber, this absorbers being coupled in parallel.

A three-way valve or some equivalent valve system controls the glycol/water flow and directs same through either the air heat absorber or the ground heat absorber. A thermostat controls the valve system in such a way that when there will risk for frost build up on the air heat absorber this is shut off and the glycol/-water flow is directed through the ground heat absorber only.

As soon as the ambient conditions permit the circuit is switched over to heat absorbtion via the air heat absorber again.

The vaporizer of the heat pump is situated either indoors or outdoors.

In one embodiment the second vaporizer may be included in the refrigerant circuit in parallel with the first vaporizer, this second vaporizer being situated outdoors and a further valve is arranged to control the flow distribution between these vaporizers.

Alternatively a second vaporizer may be included in the refrigerant circuit in series with the first vaporizer, and this second vaporizer may be situated outdoors.

Preferably a fan is arranged to force the heat exchange between the ambient air and the air heat absorber, and moreover a fan means may be arranged to force the heat exchange between the ambient air and the above mentioned second vaporizer. In the embodiment wherein the first vaporizer is situated outdoors a fan may be arranged to force the heat exchange with the ambient air.

A sensor or thermostat may be arranged to start the circulation pump, switch off the fan, shut off the valve to the second vaporizer and open the valve to the first vaporizer when the ambient air temperature sinks below a certain value at which a substantial frost formation tends to occur on a vaporizer situated outdoors, and vice versa when the ambient air temperature raised above said value.

Preferably the sensor is arranged to shut off the valve related to the second vaporizer and open the valve related to the first vaporizer when the ambient air temperature falls below said value, and vice versa when the ambient air temperature raises over said value. Alternatively a sensor may be arranged to shut off the fan for the air heat absorber, shut off the valve for the air heat absorber and open the valve to the earth heat absorber when the ambient air temperature falls below a certain value and vice versa when the ambient air temperature raises over said value. When the ambient air holds a normal moisture said value may be around −5° C.

Preferably the secondary circuit comprises a tube of plastic material. Either or both of the earth heat absorber and air heat absorber consist of a tube of plastic material, preferably in the shape of a coil. The earth heat absorber should arranged on a frost-safe depth in the ground, for example 2 meters down.

In the following the invention will be closer described in connection with exemplary embodiments with the reference to the adjoining drawings.

Figure 2:
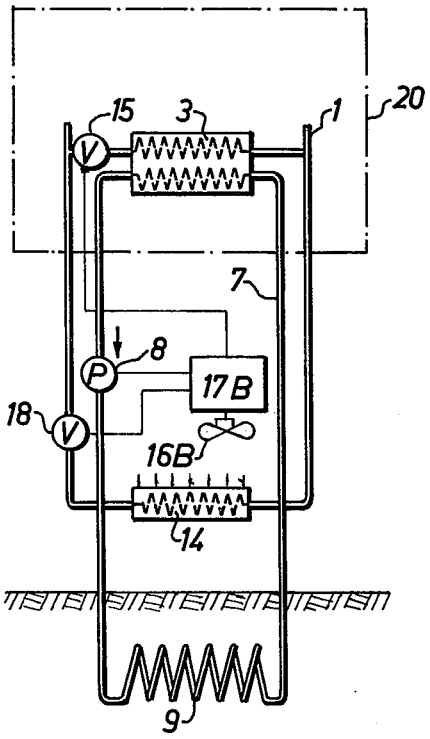
Figure 3:
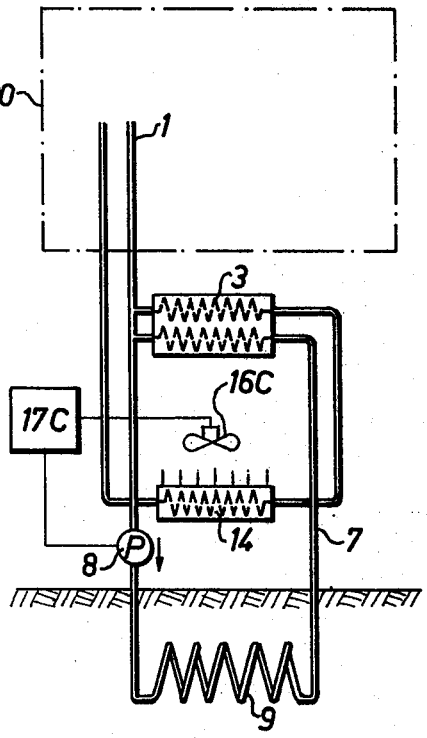
Figure 4:
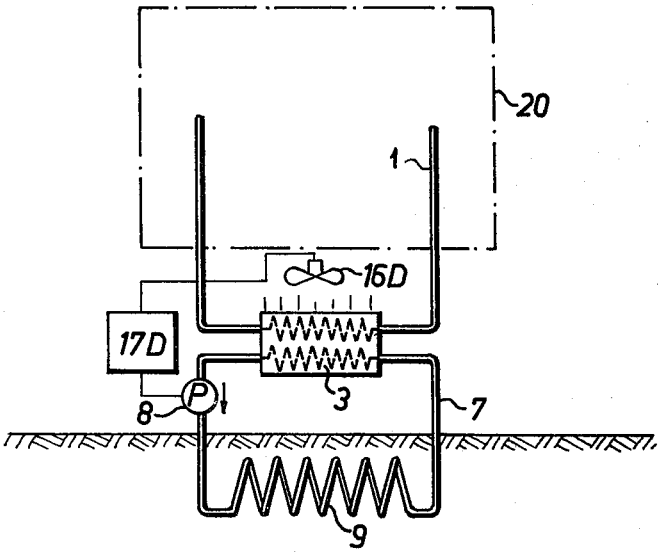

FIG. 1 illustrates a first embodiment of the inventive system. FIGS. 2–4 illustrate the alternative embodiments of the invention.

FIG. 1 shows schematically a building 20 in which a heat pump circuit 1 is arranged. The circuit 1 which is filled with a refrigerant such as Freon, comprises, in series, an expansion valve 2, a vaporizer 3, a compressor 4 and a condenser 5, and this condenser 5 is arranged to transfer the condensation heat of the refrigerant by heat exchange to one or more medias 6 such as room air, radiator water, tap water or the like a refrigerant reservoir 15, i.e., a through-flow container which collects the refrigerant condensate from the condenser 5 and serves as a buffer store. The vaporizer 3 is coupled in heat exchange relationship with a secondary circuit 7. This circuit 7 is filled with a liquid having low freezing temperature, such as a glycol/water mixture. The circuit 7 comprises a circulation pump 8 and a heat exchanger (earth heat absorber) 9 which is dug down in the ground, for example to a depth of 2 meters. A heat exchanger (air heat absorber) 10 which is arranged in heat exchange relationship with the ambient air is fitted in the secondary circuit 7 in parallel with the earth heat absorber 9. A fan 16*a* is arranged to enhance the heat exchange between the ambient air and the liquid in the heat exchanger 10. A shut off valve 11 is arranged for the ground heat absorber 9 and a shut off valve 12 is arranged for the air heat absorber 10. The valves 10 and 12 can be set to control the flow distribution between the heat exchangers 9 and 10 of the secondary circuit 7. At the temperature at which frost and ice formation start to occur on the air heat absorber 10 the valve 12 can be shut off and the valve 11 can be opened such that heat is collected only from the ground heat absorber 9 for delivery to the vaporizer 3. Sensoring and controlling means 17 can be arranged to shut off the fan 16*a*, shut the valve 12 and open the valve 11 when the ambient air temperature falls below the critical value, and to shut off the valve 11, open the valve 12 and start the fan 16*a* when the air temperature raises above the critical temperature, which we have found to be around −5° C.

In FIGS. 2–4 only that part of the apparatus which is of interest with regard to the present invention is shown but it should be noted that the refrigerant circuit of the heat further to the vaporizer 3 also comprises a compressor, a condensor, an expansion valve and other auxiliary equipment.

FIG. 2 illustrates a second embodiment of the invention, wherein the secondary circuit 7 is arranged in heat exchange relationship with an indoors situated vaporizer unit 3 of the heat pump. The heat pump circuit 1 also comprises a second vaporizer unit 14 which is situated outdoors and in heat exchange relationship with the ambient air. A fan 16*b* is arranged to enhance the heat exchange between the ambient air and the refrigerant flowing through the vaporizer unit 14. The vaporizer units 3 and 14 are coupled in parallel in the refrigerant circuit 1. A shut off valve 15 is arranged for the vaporizer unit 3 and a shut off valve 18 is arranged for the vaporizer unit 14. When the ambient air temperature falls below the critical value at which ice formation starts to occur on the vaporizer unit 14 (if this unit is used) a control means 17*b* is arranged to shut off the valve 18, open the valve 15, start the circulation pump 8 of the circuit 7 and shut off the fan 16*b*. The control means 17*b* is arranged to open valve 15, shut off valve 18, shut off pump 8 and start fan 16*b* when the ambient air temperature raises above the critical value.

At the apparatus according to FIG. 3 the secondary circuit 7 is connected in heat exchange relationship with a vaporizer unit 3 of the heat pump refrigerant circuit 1. The refrigerant circuit 1 also comprises a further vaporizer unit 14, which is connected in series with the vaporizer unit 3 and situated outdoors. A control means 17*c* is arranged to control a fan 16*c* which is arranged to enhance the heat exchange at the vaporizer unit 14, and to control the circulation pump 8 of the secondary circuit 7. As the ambient air temperature falls below that temperature at which ice formation tend to occur at the vaporizer unit 14, means 17*c* will shut off fan 16*c* and start circulation pump 8 such that the heat absorbed by the heat exchanger 9 of the secondary circuit is transferred to the vaporizer unit 3. When the ambient air raises to a certain value above the critical temperature, control means 7 will start fan 16*c* and shut off pump 8.

At the apparatus according to FIG. 4 the vaporizer 3 of the heat pump circuit 1 is situated outdoors and arranged in heat exchange relationship with the secondary circuit 7. Moreover the vaporizer 3 is arranged in heat exchange relationship with the ambient air. A fan 16*d* is arranged to enhance the heat exchange between the ambient air and the refrigerant flowing through vaporizer 3. A control means 17*d* is arranged to start fan 16*d* and to shut off the circulation pump 8 of the secondary circuit when the ambient air temperature is higher than the temperature at which ice and frost formation occur at the vaporizer 3. If the ambient air temperature falls below the temperature at which frost and ice formation occur at the vaporizer 3 means 17*d* will bring about that fan 16*d* is shut off and the circulation pump 8 of the secondary circuit 7 is started such that earth heat is collected via the heat exchanger 9 and transported to the vaporizer 3 such that earth heat is transferred to the refrigerant of circuit 1.

The ground heat absorber 9 should be dug down to a frost safe depth in the ground. The secondary circuit 7 as well as the ground heat absorber 9 and the air heat absorber 10 can advantageously consist of plastic tubing. By preferably making the entire secondary circuit inclusive of its heat exchangers of a plastic tubing, a low cost circuit is obtained which can stand to be put down into the ground and can stand the corrosion effects of the ground water. By utilizing plastic tubing for the air heat absorber the advantage is obtained that the heat exchanger not so easily will be clogged with frost and ice. This may depend on the fact that a plastic tube heat exahanger has a larger interval between the tube parts and has a larger surface than a corresponding metal flange heat exchanger, i.e. has a lower effect load per unit area.

During the relatively short period of the year when the ambient temperature is lower than above mentioned critical temperature (about −5° C) it is thus possible to let the heat pump collect heat from the ground instead of from the ambient air. The time period when the air temperature is lower than the critical temperature is at least in Sweden normally too short to bring about any lasting and substantial reduction of the ground temperature, which otherwise could affect the growth of a garden. According to the invention the advantage is moreover won that the circuit 7 does not have to be under any substantial pressure and may contain a heat transport medium of relatively low toxicity and harmfulness; and this is in contrast to the proper heat pump circuit 1, which has to stand relatively high pressures and which contains Freon or some corresponding heat transport medium.

In the embodiments according to FIGS. 1–4 there have been described how an automatic 17*a* –17*d* automatically controlls the fan, the circulation pump and various valves of the apparatus in response to the prevailing temperature relative to a critical ambient air temperature. It should however, be appreciated that these fans, pumps and valves may be controlled manually.

What is claimed is:

1. In a heat pump system comprising a refrigerant circuit (1) comprising in series an expansion valve, a first vaporizer, a compressor and a condenser which condenser is arranged to transfer condensation heat of the refrigerant medium to a medium such as radiator water, said vaporizer being arranged in heat exchange relationship with a secondary circuit which is filled with a liquid having low freezing temperature and which comprises a circulation pump (8) for the liquid, at least one earth heat absorber being included in the secondary circuit, the improvement that an air heat absorber which is situated outdoors is arranged in the secondary circuit in parallel with the earth heat absorber, and that valve means are arranged for the heat absorbers for control of the flow distribution between them.

2. A system according to claim 1 wherein a second vaporizer is connected in the refrigerant circuit and is positioned outdoors.

3. A system according to claim 2 wherein the first and the second vaporizer are arranged in parallel and wherein a valve means is arranged to control the flow distribution between the first and the second vaporizer.

4. A system according to claim 2 wherein the second vaporizer is connected in series with the first vaporizer.

5. A system according to claim 1 wherein a fan is arranged to enhance the heat exchange between the ambient air and the air heat absorber.

6. A system according to claim 2 wherein a fan is arranged to enhance the heat exchange between the ambient air and the second vaporizer.

7. A system according to claim 6 wherein the second vaporizer is arranged in parallel with the first vaporizer, and wherein a sensor is arranged to start the circulation pump, shut off the fan, close the valve of the second vaporizer when the ambient temperature falls below a certain value at which frost formation tends to occur on the air heat absorber and vice versa, when the ambient air temperature raises above said value.

8. A system according to claim 7 wherein a shut off valve is arranged for the first vaporizer and wherein said sensor is arranged to open said valve for the first vaporizer when the ambient temperature falls below said value and vice versa when the ambient air temperature raises above said value.

9. A system according to claim 5 wherein a sensor is arranged to shut off the fan, close the valve to the air heat absorber and open the valve for the earth heat absorber when the ambient air temperature falls below a certain value and vice versa when the ambient air temperature raises above said value.

10. A system according to claim 1 wherein the secondary circuit comprises a tubing of plastic material.

11. A system according to claim 1 wherein the earth heat absorber consists of a coil of plastic tubing.

12. A system according to claim 1 wherein the air heat absorber consists of a coiled tube of plastic material.

13. A system according to claim 1 wherein the earth heat absorber is positioned in the ground on frost safe depth.

14. A system according to claim 2 wherein the first vaporizer is positioned indoors.

15. A system according to claim 2 wherein the first vaporizer is positioned outdoors.

* * * * *